US007833140B2

(12) United States Patent
Ligrano et al.

(10) Patent No.: US 7,833,140 B2
(45) Date of Patent: Nov. 16, 2010

(54) CORE RESISTANCE APPARATUS

(75) Inventors: Ronald Ligrano, Culver City, CA (US); Alexander McKechnie, Marina Del Rey, CA (US); Richard George Celebrini, North Vancouver (CA)

(73) Assignee: Core X System, LLC, Rowland Heights, CA (US)

( * ) Notice: Subject to any disclaimer, the term of this patent is extended or adjusted under 35 U.S.C. 154(b) by 215 days.

(21) Appl. No.: 12/037,351

(22) Filed: Feb. 26, 2008

(65) Prior Publication Data

US 2009/0215593 A1 Aug. 27, 2009

(51) Int. Cl.
*A63B 21/02* (2006.01)

(52) U.S. Cl. ..... 482/124; 482/126

(58) Field of Classification Search ..... 482/114–122, 482/124–130, 139, 91; 473/208–217, 274–277; 24/300, 301; D21/684, 692; 128/278, 882; 446/26, 27, 28, 102, 104; 119/712, 726, 119/769, 770, 795, 816, 857
See application file for complete search history.

(56) References Cited

U.S. PATENT DOCUMENTS 861,620 A * 7/1907 Thompson ..... 482/129
3,068,002 A * 12/1962 Balne ..... 482/91
3,652,085 A * 3/1972 Cole ..... 482/129
3,743,280 A * 7/1973 Martinez ..... 482/92
4,067,569 A * 1/1978 Palumbo ..... 482/48
4,245,840 A * 1/1981 Van Housen ..... 482/124
4,733,862 A * 3/1988 Miller ..... 482/126
4,889,336 A * 12/1989 Schneiderman ..... 482/125
D316,885 S * 5/1991 Heerah et al. ..... D21/692
5,176,377 A * 1/1993 Wilkinson ..... 482/120
5,433,688 A * 7/1995 Davies ..... 482/124
5,658,203 A * 8/1997 Shub ..... 473/205
5,792,034 A * 8/1998 Kozlovsky ..... 482/124
5,852,988 A * 12/1998 Gish ..... 119/795
5,860,944 A * 1/1999 Hoffman, Jr. ..... 602/19
5,993,362 A * 11/1999 Ghobadi ..... 482/124
6,176,757 B1 * 1/2001 Lin ..... 446/115
6,273,029 B1 * 8/2001 Gish ..... 119/792
6,280,365 B1 * 8/2001 Weber et al. ..... 482/124
6,517,470 B1 * 2/2003 Chak et al. ..... 482/126
6,629,912 B2 10/2003 Downs
6,659,921 B2 * 12/2003 Vernon ..... 482/124
6,662,651 B1 * 12/2003 Roth ..... 73/379.02

(Continued)

*Primary Examiner*—Loan Thanh
*Assistant Examiner*—Daniel F Roland
(74) *Attorney, Agent, or Firm*—Wasserman, Comden & Casselman, L.L.P.; Reid Dammann

(57) ABSTRACT

A core resistance apparatus is provided. The core resistance apparatus is comprised of a rotational adjusting element having a rotational member and a first and a second rotational cord guide. The first and second rotational cord guides pivotally contact a first and a second side portion of the rotational member along a contacting means, respectively. The core resistance apparatus is comprised a first and a second resistance cord. The resistance cords each have a first and second attachment point, wherein the first and second rotational cord guides slidingly connect with the first and second resistance cords, respectively. The core resistance apparatus is comprised of a first and a second upper body connector, and a third and a fourth lower body connector. The upper and lower body connectors attach to a user, wherein the location of the rotational adjusting element adjusts to a center of gravity relative to the user movement.

17 Claims, 7 Drawing Sheets

U.S. PATENT DOCUMENTS

| | | | | |
|---|---|---|---|---|
| 7,101,324 | B2 * | 9/2006 | Matos | 482/124 |
| 7,156,747 | B2 * | 1/2007 | Perry | 473/270 |
| 7,178,632 | B2 * | 2/2007 | Casebolt et al. | 182/3 |
| 7,297,093 | B2 * | 11/2007 | Garcia Lopez | 482/124 |
| 7,314,437 | B2 * | 1/2008 | Frappier | 482/124 |
| 7,325,515 | B2 * | 2/2008 | Hetland | 119/795 |
| 7,326,157 | B2 * | 2/2008 | Wu | 482/126 |
| 2002/0187884 | A1 * | 12/2002 | McGrath | 482/121 |
| 2003/0087733 | A1 * | 5/2003 | Kim | 482/93 |
| 2003/0186791 | A1 * | 10/2003 | Downs | 482/121 |
| 2004/0116259 | A1 * | 6/2004 | Rosiles | 482/121 |
| 2006/0073955 | A1 * | 4/2006 | Garcia Lopez | 482/124 |
| 2006/0229175 | A1 * | 10/2006 | Frappier | 482/124 |
| 2008/0108486 | A1 * | 5/2008 | Vigilia | 482/124 |
| 2008/0139369 | A1 * | 6/2008 | Vigilia | 482/124 |
| 2008/0280738 | A1 * | 11/2008 | Brennan et al. | 482/129 |
| 2009/0120376 | A1 * | 5/2009 | Foster | 119/795 |
| 2009/0308329 | A1 * | 12/2009 | Sanchez | 119/795 |
| 2010/0031897 | A1 * | 2/2010 | Moeller | 119/792 |

* cited by examiner

CORE RESISTANCE APPARATUS

BACKGROUND

1) Field of the Invention

The invention relates to an exercise apparatus. More particularly, the invention relates to a core muscle resistance apparatus.

2) Discussion of the Related Art

Strength, power, speed, quickness, agility, and coordination are critical for performance in almost all sports and activities, and all depend from the core muscles of the body. The way in which an athlete resists and handles outside forces is called balance or stability, which also stems from the same muscles of the body. The better and more sport specifically athletes train their bodies, the more balanced and stable they will be during performance. The strength from the core muscles of the body extend outward through the arms and legs, connecting all movements of the upper and lower body. The stronger the core muscles the more powerful and efficient movements become.

Powerful and efficient movements require a transfer of force from through the body to achieve maximum acceleration of an appendage. This transfer of force is often a function of how well the upper and lower body are connected. By strengthening the core muscles, the athlete creates a solid unit capable of developing and transferring forces from the legs through the trunk to the arms. The sum of these integrated forces results in optimal acceleration. This is known as the kinetic-link or kinetic-chain principle. A few major sports in which this transfer of forces are critical for good performance include; Baseball, Golf, Basketball, Football, and Tennis.

In general, the "core muscles" are a group of muscles that run the length of the trunk and torso. The muscles are found in the oblique and abdominal regions, lower back, and the gluteus muscle region. These four areas of the body are responsible in framing the posture of a person. A good posture can reflect good conditioning of these muscle areas. A weak core can lead to poor posture, increasing the risk of injury and lower back pain. Strong core muscles provide the support needed to help prevent such pain and injury. A strong core contributes to proper body alignment or posture, making movement more efficient. Proper body alignment is much easier to attain when the core muscles are strong and balanced.

The emphasis in exercise and fitness has been placed on developing and maintaining strong core muscles, but most programs just strengthen the abdominal muscles. Exercising equipment dedicated to strengthening the core muscles currently exist and generally include medicine balls and balance boards, however, athletes and non-athletes are in search of a better way to target and isolate specific core muscle groups. Due to structure, present exercise equipment is limited in the way in which it provides strength training and is unable to accommodate the proper techniques needed in isolating and exercising the core muscles.

BRIEF DESCRIPTION OF THE DRAWINGS

The invention is described by way of example with reference to the accompanying drawings wherein.

DETAILED DESCRIPTION OF THE INVENTION

Figure 1:
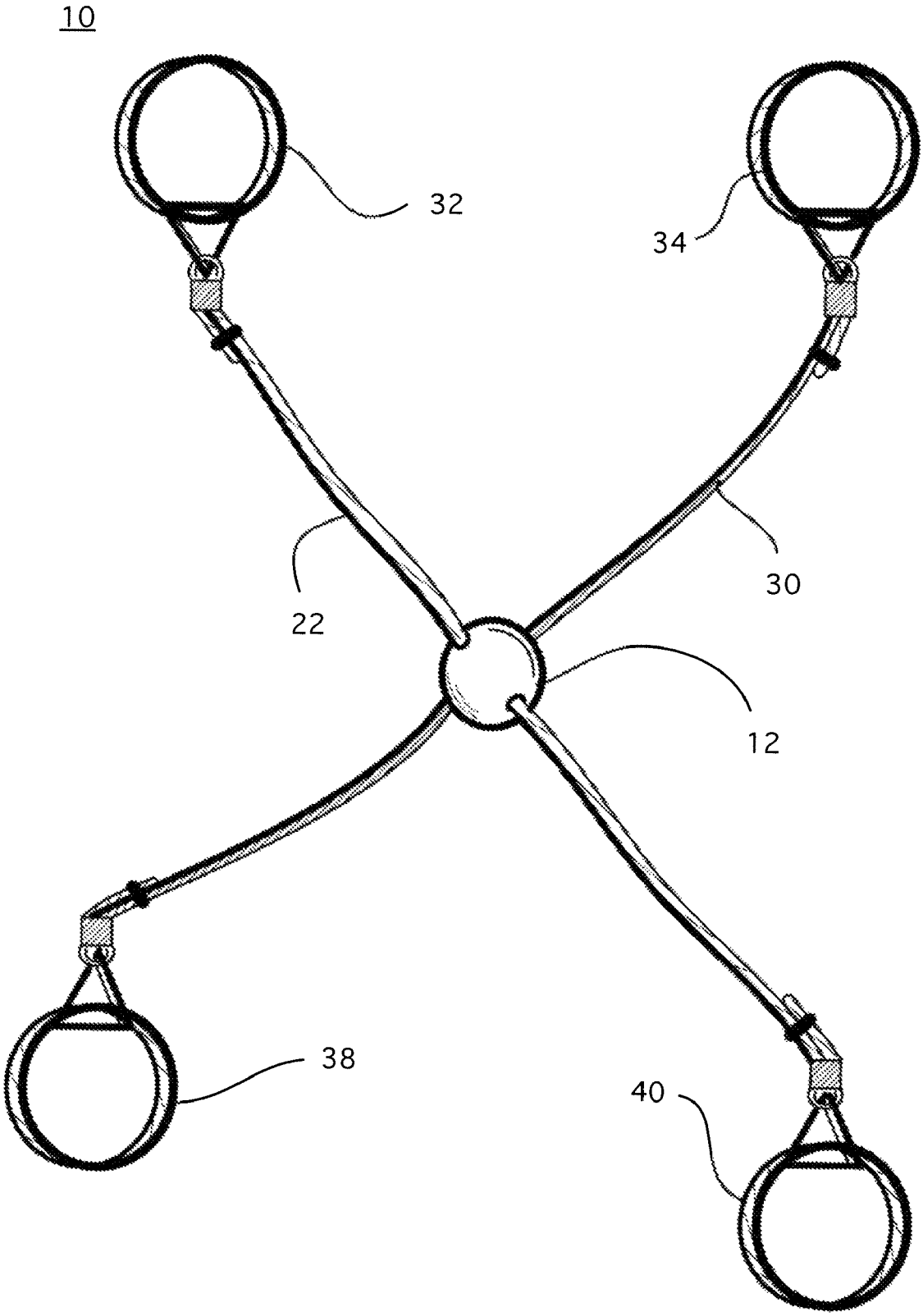
FIG. 1 illustrates a core resistance apparatus.

FIG. 1 illustrates a core resistance apparatus 10. The core resistance apparatus 10 is comprised of a rotational adjusting element 12, a first and a second resistance cord 22 and 30, respectively, a first and a second upper body connector, 32 and 34, respectively, and a first and a second lower body connector, 38 and 40, respectively.

Figure 2:
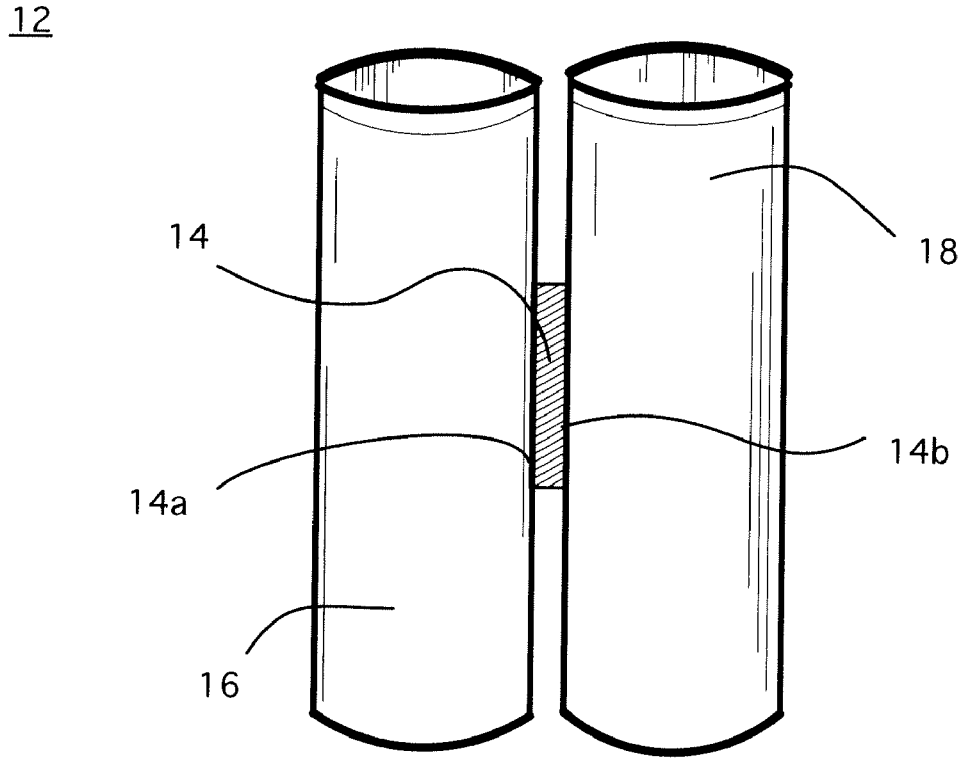
FIG. 2 illustrates a side view of a rotational adjusting element.
Figure 3:
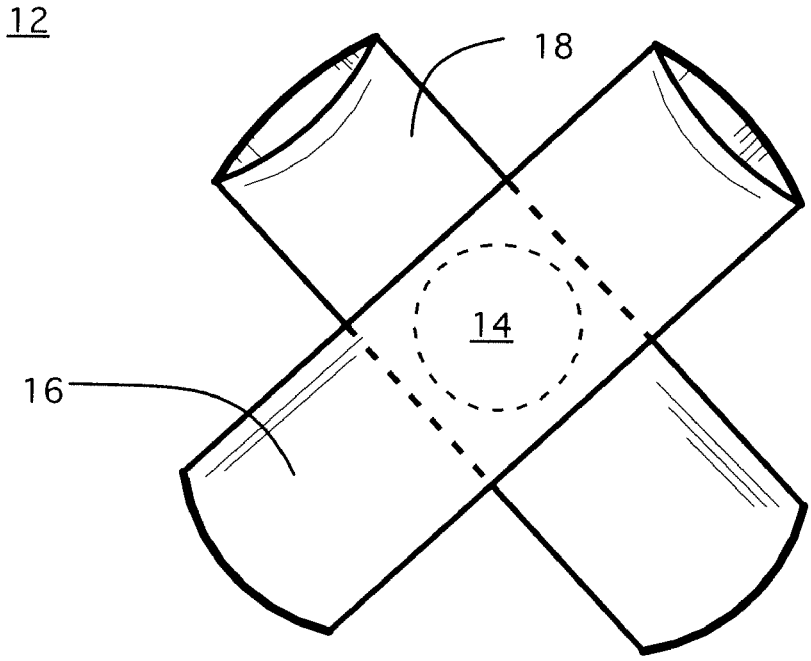
FIG. 3 illustrates a front perspective of the rotational adjusting element.

FIGS. 2 and 3 illustrate the rotational adjusting element 12 in detail. The rotational adjusting element 12 is comprised of a rotational member 14 having a first and a second side portion, 14*a* and 14*b*, respectively, a first and a second rotational cord guide, 16 and 18, respectively. The first and second cord guides, 16 and 18, and the rotational member 14 are held along a contacting means 14*c* (illustrated in FIG. 12). The second rotational cord guide 18 is located anterior to the first rotational cord guide 18 within the rotational adjusting element 12.

Figure 4:
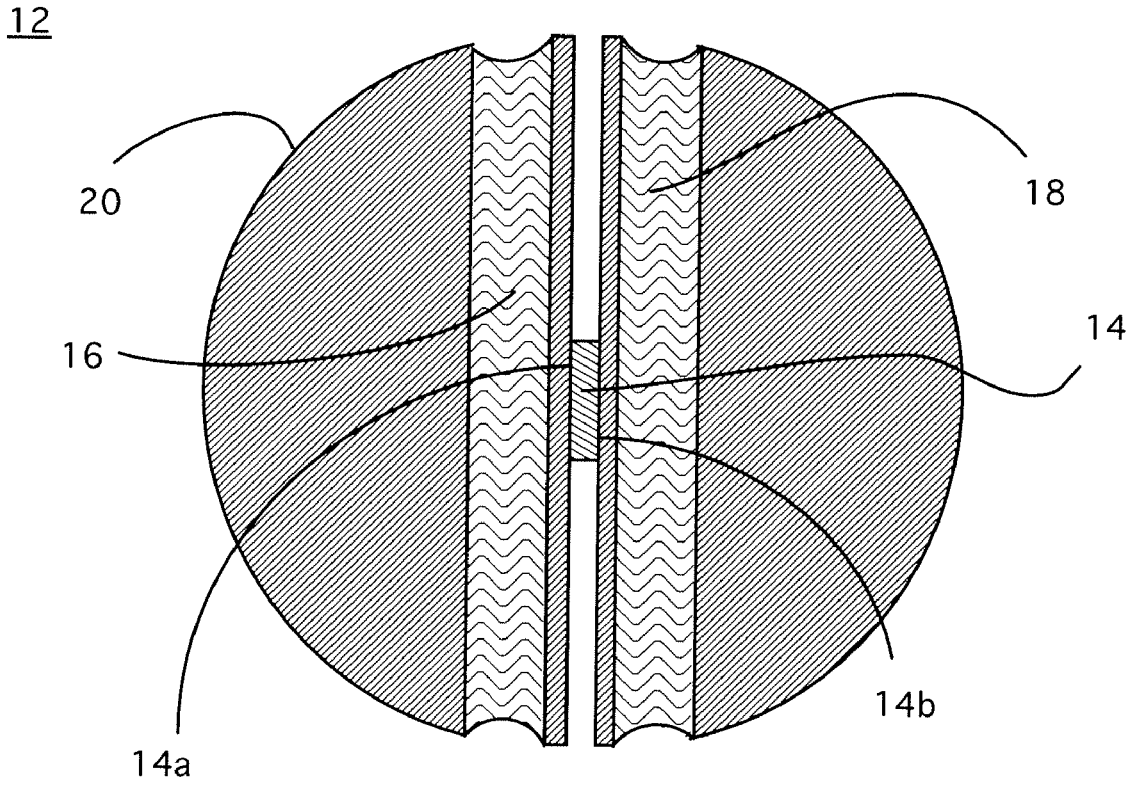
FIG. 4 illustrates a cross sectional side view of the rotational adjusting element including a protective outer housing.
Figure 5:
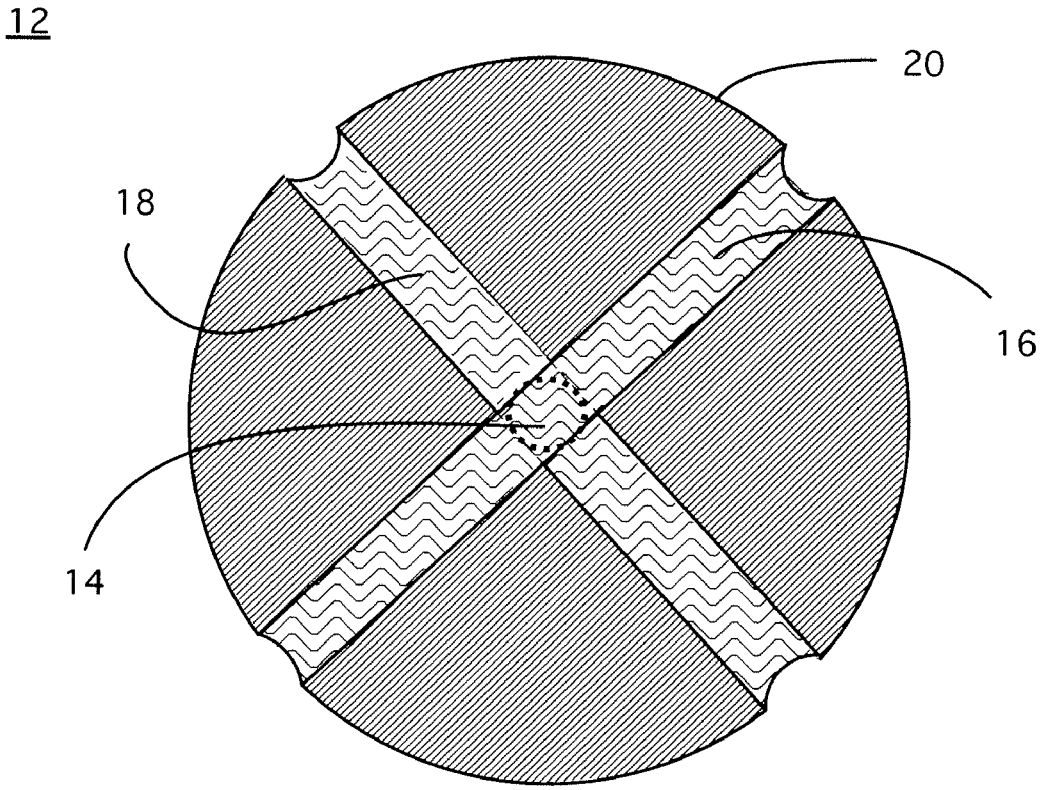
FIG. 5 illustrates a cross sectional front view of the rotational adjusting element and the protective outer housing.

FIGS. 4 and 5 illustrate a cross sectional side view and cross sectional front view, respectively, of the rotational adjusting element 12. The rotational adjusting element 12 includes a protective outer housing 20. The first and second rotational cord guides, 16 and 18, pivotally contact to the first and second side portions, 14*a* and 14*b*, of the rotational member 14, within the protective outer housing 20.

Figure 6:
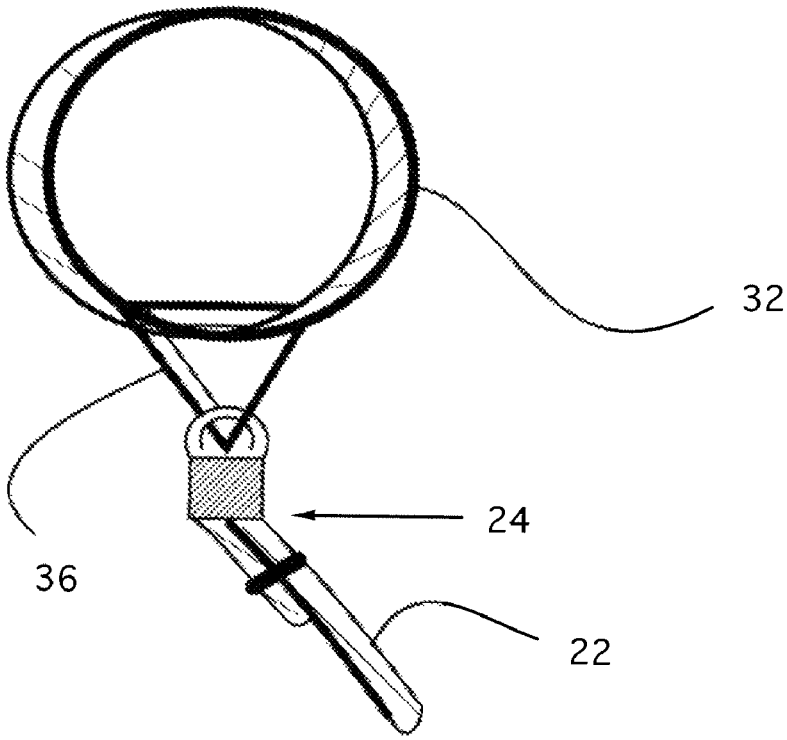
FIG. 6 illustrates a first resistance cord and a first upper body connector.

FIG. 6 illustrates the first resistance cord 22 attaching to the first upper body connector 32. FIG. 6 is illustrative of both first and second resistance cords, 22 and 30, and first and second upper body connectors, 32 and 34, wherein the first and second resistance cords, 22 and 30, include a first attachment point 24. The first attachment point 24 attaches to a first attachment means 36 of the first and second upper body connector, 32 and 34, securing the first and second resistance cords, 22 and 30, to the first and second upper body connectors, 32 and 34, and to a user.

Figure 7:
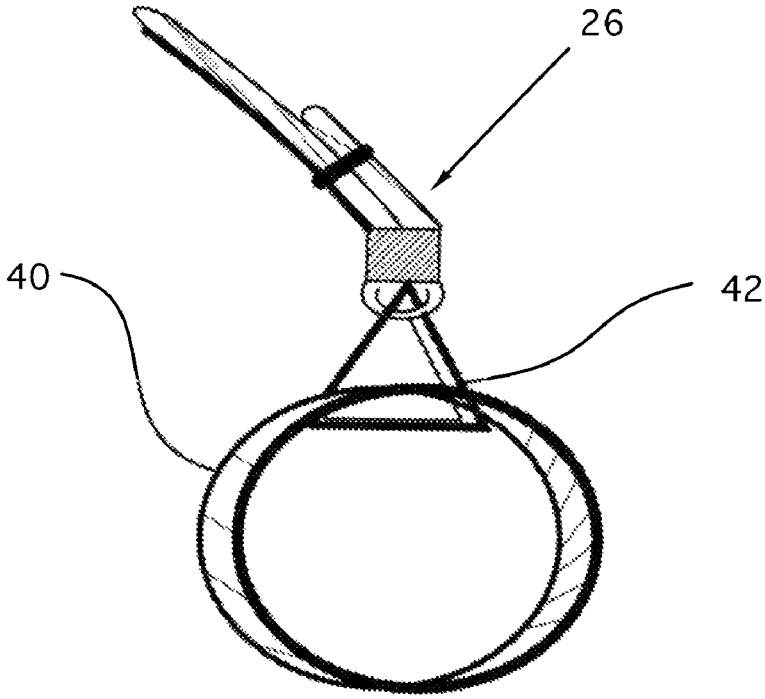
FIG. 7 illustrates the first resistance cord and a fourth lower body connector.

FIG. 7 illustrates the first resistance cord 22 attaching to the fourth lower body connector 40. FIG. 7 is illustrative of both first and second resistance cords, 22 and 30, and third and fourth lower body connectors, 38 and 40, wherein the first and second resistance cords, 22 and 30, include a second attachment point 26. The second attachment point 26 attaches to a second attachment means 42 of the third and fourth lower body connector, 38 and 40, securing the first and second resistance cords, 22 and 30, to the third and fourth lower body connectors, 38 and 40, and to the user.

Figure 8:
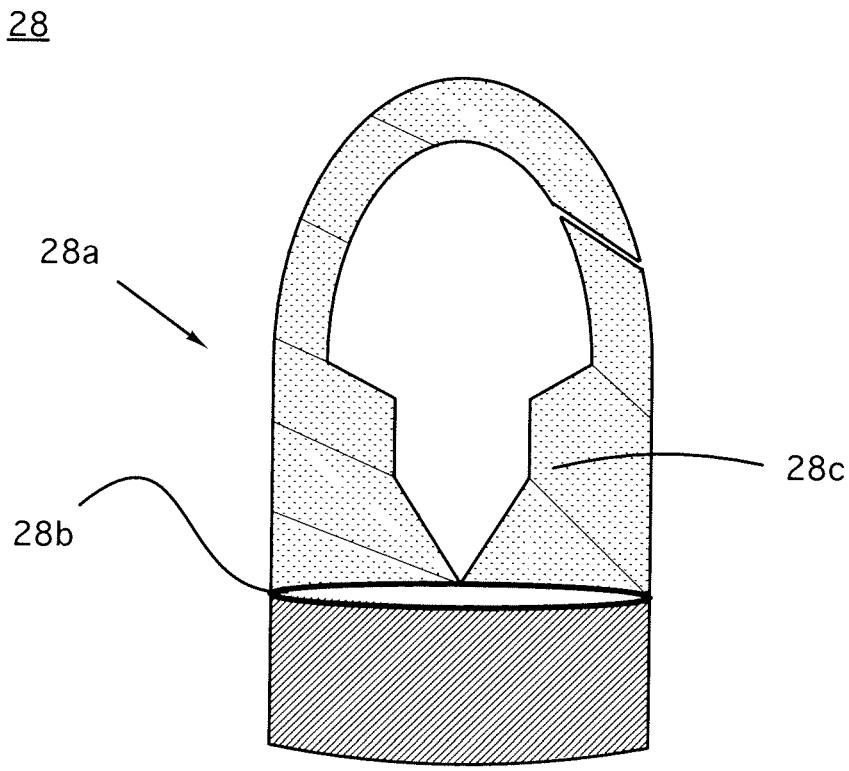
FIG. 8 illustrates a side view of a securing clip of a retaining adjustment fastener.
Figure 9:
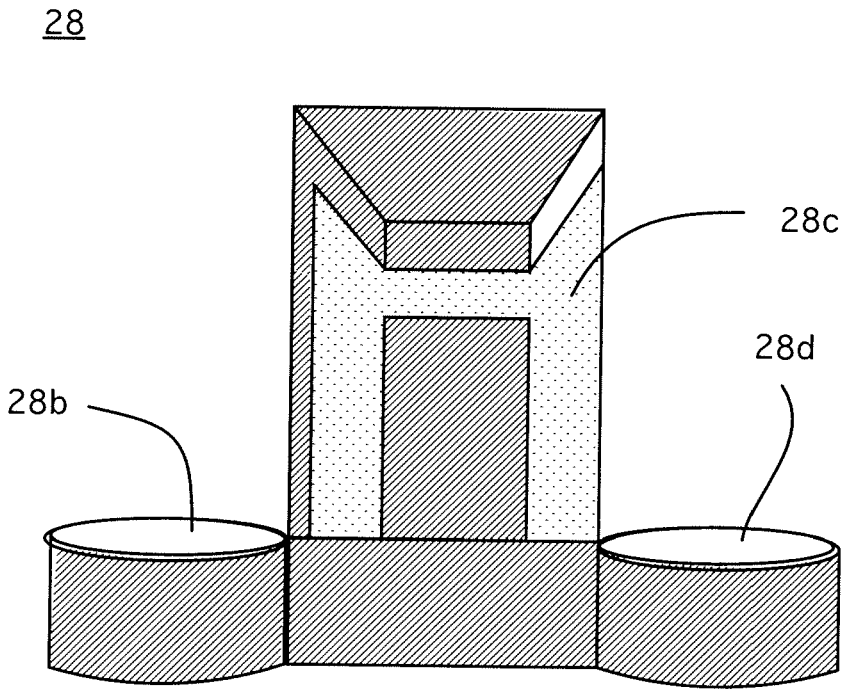
FIG. 9 illustrates a front view of the securing clip.
Figure 10:
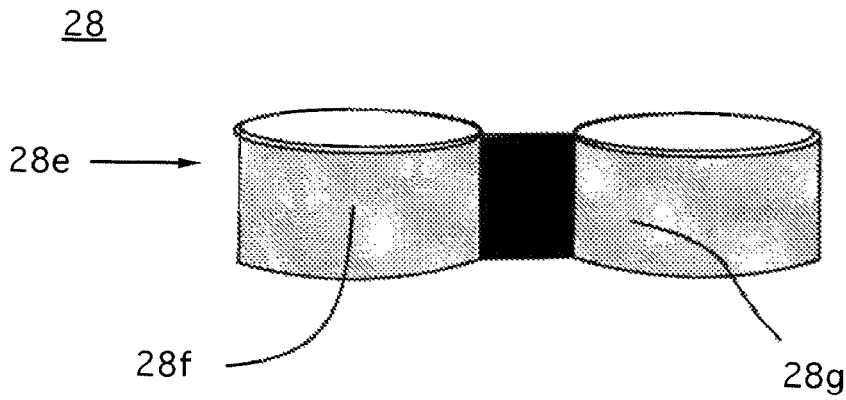
FIG. 10 illustrates a front view of a retaining lock of the retaining adjustment fastener.

FIGS. 8, 9, and 10 illustrate a side view and front view, respectively, of an embodiment of the first attachment point 24. FIGS. 8 and 9 are illustrative of both first and second attachment points, 24 and 26. In an embodiment, the first attachment and second attachment points, 24 and 26, comprise a retaining adjustment fastener 28. The retaining adjustment fastener 28, includes a securing clip 28*a*, and a retaining lock 28*e*, seen in FIG. 10. The securing clip 28*a* includes a first and second opening, 28*b* and 28*d*, respectively, and an eyelet wedge 28*c*. The retaining lock 28*e* includes a first and a second opening, 28*f* and 28*g*, respectively.

Figure 11:
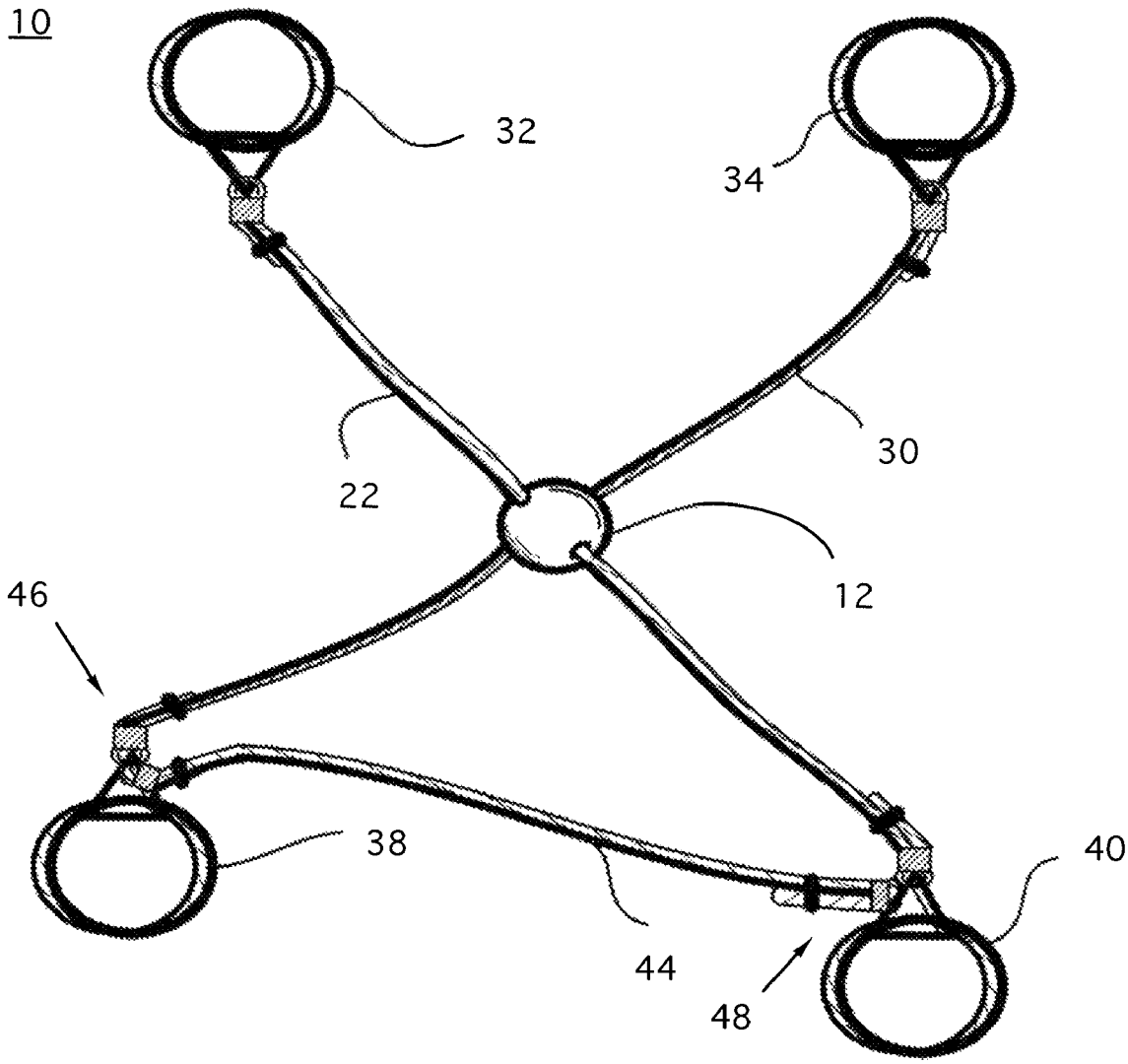
FIG. 11 illustrates the core resistance apparatus including an interconnecting member.

FIG. 11 illustrates the core resistance apparatus 10. In an embodiment, the core resistance apparatus 10 includes at least one interconnecting member 44. The at least one interconnecting member 44 includes a third and a fourth attachment point, 46 and 48, respectively. The third and fourth attachment points, 46 and 48, attach to the second attachment means 42, which is also attached to the second attachment points 26, and third and fourth lower body connectors, 38 and 40.

Figure 12:
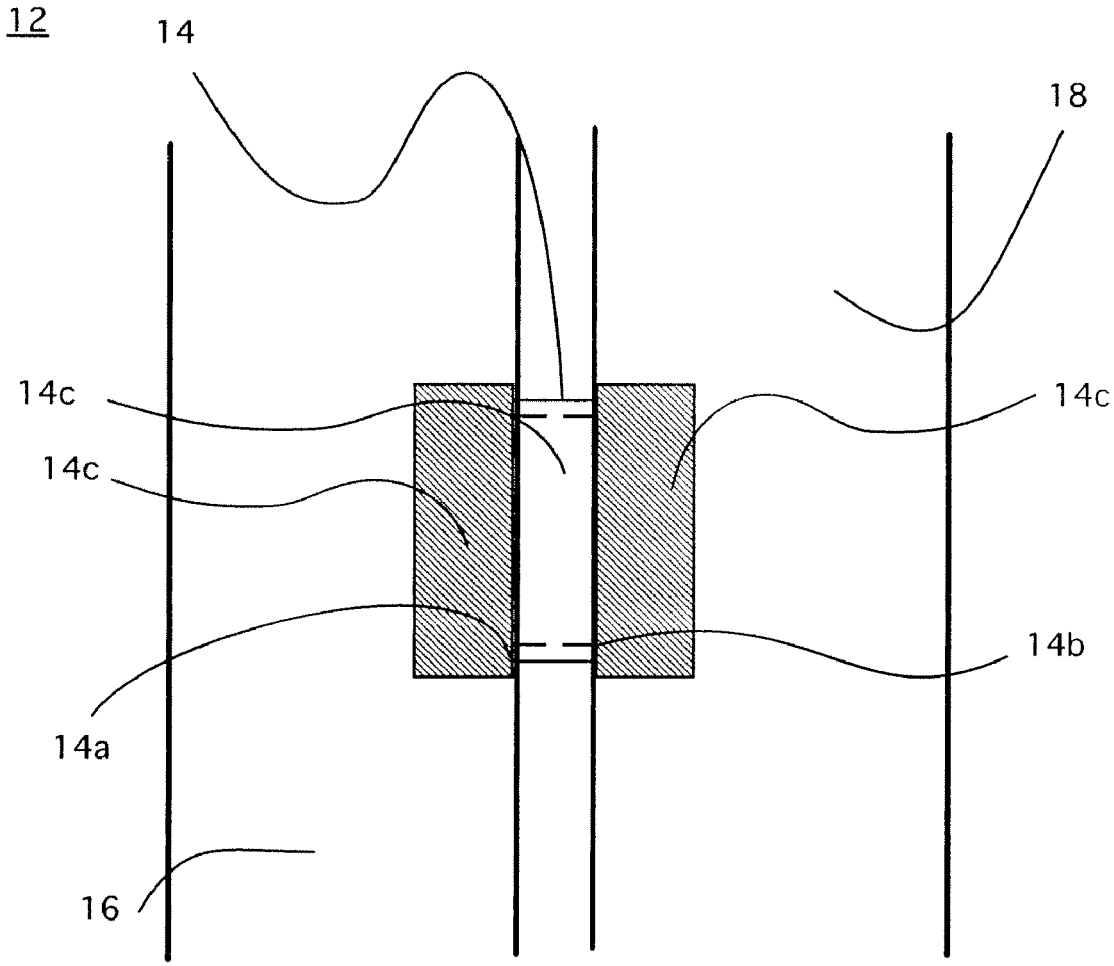
FIG. 12 illustrates the rotational adjusting element including a contacting means.

FIG. 12 illustrates the rotational adjusting element 12 in detail. The rotational member 14 having the first and second side portion, 14*a* and 14*b*, respectively, the first and a second rotational cord guide, 16 and 18, respectively, are held along the contacting means 14*c*. In this embodiment, the contacting means 14*c* is a rivet.

1. Attachment

In use, the user attaches the upper and lower body connectors, 32 and 34, and 38 and 40, respectively, of the core resistance apparatus 10, to connection points on the user. In an embodiment, the connection points are the wrists and thighs. In another embodiment, the upper and lower connectors, 32 and 34, and 38 and 40, are comprised of Velcro straps. In another embodiment, the connectors can be made of loop adjusting straps or the structural equivalent, providing comfort of fit and ease of use and attachment.

The upper and lower body connectors, 32 and 34, and 38 and 40, attach to the first and second attachment points, 24 and 26, by the first and second attachment means, 36 and 42. In an embodiment, the first and second attachment means, 36 and 42, include a retaining member, which in one embodiment is triangular. In another embodiment, the first and second attachment means, 36 and 42, include a fastener, ring or similar structure which facilitates an ease of use and attachment.

In an embodiment, the first and/or second attachment points, 24 and 26, include the retaining adjustment fastener 28. The retaining adjustment fastener 28, includes the securing clip 28*a* and the retaining lock 28*e*. In another embodiment, the retaining adjustment fastener 28 includes only the securing clip 28*a*. In yet another embodiment, the second opening 28*d* of the securing clip 28*a* includes a release opening. In this embodiment, the release opening allows the first and/or second resistance cords, 22 and 30, to be laterally pulled out of the second opening 28*d*, as opposed to directly out of the opening, and thus the eyelet wedge 28*c*, and adjusted by being pulled to the desired length and placing the first and/or second resistance cords, 22 and 30, back into the eyelet wedge 28*c* and release opening. In another embodiment, as a secondary measure, the first and/or second resistance cords, 22 and 30, include formed ends within an increased diameter over that of the mentioned openings, preventing retraction.

Before the attachment of the securing clip 28*a* to the first and/or second attachment means, 36 and 42, the first and second resistance cords, 22 and 30, are inserted through the first openings, 28*f* and 28*b*, of the retaining lock 28*e* and the securing clip 28*a*, respectively. The first and second resistance cords, 22 and 30, are then inserted into the eyelet wedge 28*c* of the securing clip 28*a*, and after a desired length is reached are secured into the second openings, 28*d* and 28*g*, of the securing clip 28*a* and retaining lock 28*e*, respectively. The result being that the first and second resistance cords, 22 and 30, are effectively secured and adjusted to the specifications of the user.

After the first and second resistance cords, 22 and 30, are effectively attached and secured to the first and/or second attachment means, 36 and 42, the core resistance apparatus 10 may require additional adjustment(s) due to the specifications of the user, including height and weight. In an adjustment scenario, the first and/or second resistance cords, 22 and 30, are retrieved from the second openings, 28*g* and 28*d*, and pulled out of the eyelet wedge 28*c* of the securing clip 28*a*. After a desired length is reached, the first and second resistance cords, 22 and 30, are secured into the eyelet wedge 28*c* and second openings, 28*d* and 28*g*. As described previously, in an embodiment, the securing clip 28*a* includes the release opening within at least one opening. The result being the first and second resistance cords, 22 and 30, effectively secured and adjusted to the specifications of the user.

In an embodiment, the first attachment points 24 include a retaining adjustment fastener 28, which attach to the first attachment means 36. In another embodiment, the first and second attachment points, 24 and 26, include the retaining adjustment fastener 28, attaching to the first and second attachment means, 36 and 42, respectively. In this embodiment, the core resistance apparatus 10 is provided with an adjustment package that spans to all locations where the apparatus is attached to the user, allowing for more options for the adjustment feature.

In an embodiment, the core resistance apparatus 10 includes the at least one interconnecting member 44. The interconnecting member 44 includes the third and fourth attachment points, 46 and 48, respectively. In another embodiment, the third and fourth attachment points, 46 and 48, include the retaining adjustment fastener 28, which in another embodiment, includes only the securing clip 28*a*, operating similarly to the first and/or second attachment points, 24 and 26. In yet another embodiment, the second opening 28*d*, and/or 28*g*, includes the release opening described herein. This embodiment is included within at least one opening of the retaining adjustment fastener 28, with or without the retaining lock 28*e*.

In an embodiment, the third and fourth attachment points, 46 and 48, attach to both the first or second attachment means, 36 and 42. In another embodiment, the third and fourth attachment points, 46 and 48, attach to one of the first and one of the second attachment means, 36 and 42. The mentioned configurations provides the user a variety of resistance training modules.

2. Movement

After securing and adjusting the first and second resistance cords, 22 and 30, to the user, the user then maintains a position, establishing a first center of gravity. The user rotates or moves in a first direction, moving at least one of the lower and/or at least one of the upper body connectors, 32, 34, 38, and 40 and causing the first and/or second resistance cords, 22 and 30, to exhibit a first resistance force.

An effort force, which is exhibited by the user, is the force required to overcome a resistance force. The resistance force is a function of size (diameter) and weight measurements, tensile strength, and percent elongation. The relationship of two forces is exhibited in Newton's Third Law of Motion—"Forces always act in equal but opposite pairs." Thus, the relationship between the resistance and effort force is represented by the following equation:

$$R \times D \text{ sub. } R = E \times D \text{ sub. } E.$$

R=resistance force, D sub. R=resistance distance, E=effort force, and D sub. E=effort distance.

As the user increases the effort force, the resulting resistance force(s) increase(s) of the first and/or second resistance cords, 22 and 30. In order to achieve equilibrium, the user must counter the resistance force using the opposite connected appendage, or in order to move that opposite connected appendage in the opposite direction, overcome the resistance force of the first and second resistance cords, 22 and 30.

During movement or rotation, the first and second resistance cords, 22 and 30, elongate from the effort force expended by the user, generating a series of resistance forces, each increasing as a function of distance. The first and second cord guides, 16 and 18, of the rotational adjusting element 12, slidingly connect with the first and second resistance cords, 22 and 30. During each successive movement or rotation, the first and second cord guides, 16 and 18, slide to at least one position along the first and second resistance cords, 22 and 30, forming a junction at a center of gravity relative to user movement.

The first and/or second cord guides, 16 and 18, rotate and/or pivot, providing a more linear connection between points connected to the user. In one embodiment, the first and second resistance cords, 22 and 30, are located within the first and second rotational cord guides, 16 and 18. In another embodiment, the first and second resistance cords, 22 and 30, can be within a structure which secures the cords within a groove. In another embodiment, the first and second rotational cord guides, 16 and 18, are fully enclosed in cylindrical tubes.

While the user is moving, the first center of gravity shifts, establishing a second center of gravity. The rotational adjusting element 12 then rotates and adjusts from the movement or rotation of the first and second resistance cords, 22 and 30, the connection between the first and second cord guides, 16 and 18, and the first and a second side portions, 14*a* and 14*b*, of the rotational member 14. Given the interaction between the first and second cord guides, 16 and 18, and the first and second resistance cords, 22 and 30, the rotational adjusting element 12 then adjusts along plane(s) of an x-axis and/or y-axis and/or z-axis to accommodate the changing center of gravity of the user.

The rotation of the rotational adjusting element 12 is accomplished by the first and second cord guides, 16 and 18, which contact the first and a second side portions, 14*a* and 14*b*, of the rotational member 14, and are held along the contacting means 14*c*. The elements are held in contact, as to facilitate rotation. The contacting means 14*c* can include a screw, bolt, pin, fastener, rivet or structural equivalent which facilitates the free rotation of the element 12.

The composition of the rotational member 14 can be such that it withstand rotational friction. In an embodiment, the rotational member 14 is comprised of nylon. In another embodiment, the rotational member 14 is comprised of a metal, plastic and/or carbon or silicon based material. The rotational member 14 can also encompass a variety of shapes and sizes. In another embodiment, the rotational member 14 is a disc shape.

The protective cover 20 is necessary to protect the components of the rotational adjusting element 12 from the outside environment, otherwise increasing the lifespan of the core resistance apparatus 10. In an embodiment, the protective cover 20 is comprised of Acrylonitrile Butadiene Styrene or "ABS." In another embodiment, the protective cover 20 is comprised of polyvinyl chloride or "PVC." In another embodiment, the protective cover 20 is hemispherical, and encompasses a respective cord and guide. In yet another embodiment, the protective cover 20 in its hemispherical shape, encompasses both the first and second resistance cords, 22 and 30, and the respective first and second rotational cord guides, 16 and 18, forming a sphere of two interconnected hemispheres, separated only by the rotational member 14.

The use of the core resistance apparatus 10 in the above mentioned configuration increases recruitment and contraction of all the intrinsic core muscles, making the lower and upper extremities connected under resistance forces. The force or movement generated by an extremity will produce an immediate force on the contra-lateral, or opposite extremity. Controlled resistance in stabilizing the movement from the opposite limb reinforces the muscle recruitment in the core muscles and also assists in maintaining a balance and a steady center of gravity.

An advantage of the invention is the rotational adjusting element 12. Without rotation, the resistance forces are compromised, leading to the placement of stress along the structural elements holding the resistance cables or cords. Furthermore, given that a variety of movements and exercises are needed in exercising the core muscles, an advantage is that the resistance cords rotate unhindered, responding to any movement generated by the user. The rotation is accomplished by the structure of the rotational adjusting element 12, which provides for linear resistance between any two connections on the user, a feature that maximizes user training and strengthening of the core muscles.

As a user moves, each successive motion changes the center of gravity. The center of gravity is a theoretical point around which the body's weight is evenly distributed or where the weight force of an object can be considered to act. The center of gravity will vary from one person to another, and it will vary according to the activity that is being performed. As such, an advantage of the invention is the center of gravity adjustment. Exercising without a center of gravity adjustment, the user will be unable to accomplish the exercises or movements necessary in exercising the core muscles of the body.

The rotational adjusting element 12 is able to adjust for the movement and/or rotation of the user due to the interaction between the rotational adjusting element 12 and the first and second resistance cords, 22 and 30. Each time a subsequent center of gravity is established during movement, the rotational adjusting element 12 automatically follows. The rotational adjusting element 12 provides a junction for the first and second resistance cords, 22 and 30, at a center of gravity relative to the user. The rotational adjusting element 12 concentrates the exhibited forces at that junction, which provides for proper training of the core muscle group.

Core conditioning and abdominal conditioning have become synonymous in recent years, but the core muscles have an action much broader than the abdominals. The "core muscles" actually consist of many different muscles that stabilize the spine and pelvis, which run the entire length of the torso. These muscles provide a solid foundation for efficient and precise movement of the arms and legs. Core muscles help control movement, transfer energy, and shift body weight, moving more quickly in any direction.

The goal of core muscle strengthening is to maintain a solid stable foundation and transfer energy from the center of the body out to the limbs in energy efficient and precise movements. The only way to accomplish this goal is with the appropriate resistance training and use of equipment that can structurally accommodate new techniques needed to isolate these important interconnection regions.

While certain exemplary embodiments have been described and shown in the accompanying drawings, it is to be understood that such embodiments are merely illustrative and not restrictive of the current invention, and that this invention is not restricted to the specific constructions and arrangements shown and described since modification may occur to those ordinarily skilled in the art.

What is claimed:

1. A core resistance apparatus, comprising:

a rotational adjusting element including a rotational member, the rotational member having a first and a second side portion, and a first and a second rotational cord guide, the first and second rotational cord guides contact the first and second side portions of the rotational member along a contactor, respectively, the first cord guide pivotally rotating with the second cord guide via the rotational member, the first rotational cord guide located anterior to the second rotational cord guide within the rotational adjusting element;

a first and a second resistance cord, the resistance cords each having a first and second attachment point, the first and second rotational cord guides slidingly connect with the first and second resistance cords, respectively, wherein the rotational adjusting element includes at least one protective outer housing covering a respective resistance cord and cord guide;

a first and a second upper body connector, including a first attachment, the first attachment attaching to the first and second resistance cords first attachment points, respectively; and a third and a fourth lower body connector, including a second attachment, the second attachment attaching to the first and second resistance cords second attachment points, respectively, the upper and lower body connectors capable of attaching to a user, wherein the location of the rotational adjusting element adjusts to a center of gravity relative to the user movement.

2. The resistance apparatus of claim 1 wherein the protective outer housing is hemispherical.

3. The resistance apparatus of claim 1 wherein the rotational member is a disc.

4. The resistance apparatus of claim 1 wherein the rotational member is comprised of nylon.

5. The resistance apparatus of claim 1 wherein the first attachment points comprise a retaining adjustment fastener connecting to the first attachment.

6. The resistance apparatus of claim 5 wherein the first attachment includes a retaining member.

7. The resistance apparatus of claim 1 wherein the second attachment points comprise a retaining adjustment fastener connecting to the second attachment.

8. The resistance apparatus of claim 7 wherein the second attachment includes a retaining member.

9. The resistance apparatus of claim 1 wherein the upper and lower body connectors are adjustable Velcro straps.

10. The resistance apparatus of claim 1 including at least one interconnecting member having a third and a fourth attachment point attaching to any two of the first and second attachment.

11. A core resistance apparatus, comprising:

a rotational adjusting element including a rotational member, the rotational member having a first and a second side portion, and a first and a second rotational cord guide, the first and second rotational cord guides contact the first and second side portions of the rotational member along a contactor, respectively, the first cord guide pivotally rotating with the second cord guide via the rotational member, the first rotational cord guide located anterior to the second rotational cord guide within the rotational adjusting element; and a first and a second resistance cord including a first and a second upper body connector, respectively, and a third and a fourth lower body connector, respectively, the first and second rotational cord guides slidingly connect with the first and second resistance cords, respectively, the rotational adjusting element including at least one protective outer housing covering a respective resistance cord and cord guide, the upper and lower body connectors capable of attaching to a user, wherein the location of the rotational adjusting element adjusts to a center of gravity relative to the user movement.

12. The resistance apparatus of claim 11 wherein the protective outer housing is hemispherical.

13. The resistance apparatus of claim 11 wherein the rotational member is a disc.

14. The resistance apparatus of claim 11 wherein the rotational member is comprised of nylon.

15. The resistance apparatus of claim 11 wherein the upper and lower body connectors are adjustable Velcro straps.

16. The resistance apparatus of claim 11 including at least one interconnecting member having a third and a fourth attachment point attaching to any two of the upper and lower body connectors.

17. A core resistance apparatus, comprising:

a rotational adjusting element including a rotational member, the rotational member having a first and a second side portion, and at least a first and a second rotational cord guide, the first and second rotational cord guides contacting to the first and second side portions of the rotational member along a contactor, respectively, the first cord guide pivotally rotating with the second cord guide via the rotational member, the first rotational cord guide located anterior to the second rotational cord guide within the rotational adjusting element; and at least a first and a second resistance cord including at least a first and a second upper body connector, respectively, and at least a third and a fourth lower body connector, respectively, the first and second rotational cord guides slidingly connect with the first and second resistance cords, respectively, the rotational adjusting element including at least one protective outer housing covering a respective resistance cord and cord guide, the upper and lower body connectors capable of attaching to a user, wherein the location of the rotational adjusting element adjusts to a center of gravity relative to the user movement.

* * * * *